United States Patent [19]

Richardson

[11] Patent Number: 4,649,815

[45] Date of Patent: Mar. 17, 1987

[54] SCREEN PRINTING HEAD ASSEMBLY

[76] Inventor: Orland W. Richardson, 5730 Sinclair Rd., Columbus, Ohio 43229

[21] Appl. No.: 727,019

[22] Filed: Apr. 25, 1985

[51] Int. Cl.[4] ..... B41F 15/34

[52] U.S. Cl. ..... 101/126; 101/127.1; 101/128

[58] Field of Search ..... 101/115, 123, 126, 127, 101/127.1, 128, 128.1, DIG. 12

[56] References Cited

U.S. PATENT DOCUMENTS

| | | | |
|---|---|---|---|
| 1,494,798 | 5/1924 | Odajian | 101/123 |
| 2,021,959 | 11/1935 | Huebner | 101/DIG. 12 |
| 2,076,474 | 4/1937 | Luckie | 101/126 |
| 2,369,602 | 2/1945 | Petty et al. | 101/127 |
| 2,532,802 | 12/1950 | Farwell | 101/114 |
| 2,613,595 | 10/1952 | Weldon | 101/126 |
| 2,818,803 | 1/1958 | Leverson | 101/127.1 |
| 3,264,980 | 8/1966 | Rudolph et al. | 101/126 |
| 3,483,820 | 12/1969 | Schuttenberg | 101/127.1 |
| 3,744,412 | 7/1973 | Grue et al. | 101/126 |
| 3,795,189 | 3/1974 | Jaffa | 101/126 |
| 4,315,461 | 2/1982 | Harpold | 101/126 |

FOREIGN PATENT DOCUMENTS

| | | | |
|---|---|---|---|
| 208462 | 1/1908 | Fed. Rep. of Germany | 101/128 |
| 279941 | 11/1914 | Fed. Rep. of Germany | 101/128 |

*Primary Examiner*—William Pieprz

*Attorney, Agent, or Firm*—Francis T. Kremblas, Jr.

[57] ABSTRACT

A multiple registration position screen mounting apparatus or printing head assembly particularly well-suited for screen printing of jersey numerals of like indicia on garments. The printing head assembly of the present invention includes a screen receiving socket portion slideably mounted for horizontal movement between a plurality of releasably fixed registration positions related to the desired placement of one and two digit numerals on athletic jerseys or the like. The printing head assembly is fixed to a conventional vertically pivoted arm mounted on a main frame adjacent to a pallet and includes a pair of horizontal guide bars upon which a carriage forming a screen receiving socket portion is slideably mounted. A registration plate is fixed to the main frame and is provided with spaced positioning in slots adapted to mate with a locking pin depending from the socket portion to releasably fit the socket portion in one of the predetermined positions of travel along the guide bars. The socket portion has a recessed opening adapted to removably receive the leading or inner end of a screen frame in a close tolerance fit to automatically and precisely position each screen in the same mounting position on the slideably carriage.

5 Claims, 8 Drawing Figures

SCREEN PRINTING HEAD ASSEMBLY

BACKGROUND

Screens used in direct screen printing are typically made using a photographic process to create the desired image on the screen. Therefore the screens and its associated frame must be accurately located when mounted on the printing apparatus to assure proper placement of the printed image onto the garment which is held on the pallet of the apparatus. The screen frame must be registered or positioned in lateral, vertical and longitudinal directions relative to the pallet and the material mounted thereon to assure quality of the printing process. When more than one color is necessary, the precise registration or positioning becomes even more critical. Such screens are removably mounted to a printing head which forms a portion of the printing apparatus.

Screen printing has grown over the past several decades into a very high volume business. One of the larger segments of this industry requires the printing of numerals upon athletic shirts and jerseys for high school, college, professional and amateur athletic teams as well as for casual wear sport jerseys and T-shirts.

Most athletic jerseys and shirts include numerals on the back and front. The more elaborate and expensive jerseys include numbers on the sleeves or shoulders. In many application, a two color design is required wherein the primary numeral is bordered in a second color. Typically the front, back and sleeve numerals are of different sizes which require three separate screen designs for each numeral used.

Prior to the present invention, athletic shirt manufactureres were required to have a stock of approximately 100 silk screens including the frame, to represent the numerals 0 to 99 for each color and each size to be used. Another 100 screens in each size were required for a two color numeral printing. Therefore shirts or jerseys having two-color front and rear numerals required a total of 400 individual printing screens. If sleeve or shoulder numerals are included, an additional 200 screens were needed.

Further, after each numeral has been printed, each screen must be removed and another screen positioned and fixed onto the screen printing head assembly which lies above the pallet upon which the workpiece garment is placed. On conventional apparatus, this procedure required the user to loosen set screw type fastening devices, remove the screen, replace the new screen and accurately re-position the new screen by manual eye alignment prior to re-tightening the screw-type fastening devices In two-color processes, the precise placement or registration of the first and second color screens is imperative to assure that the outline secondary color is properly printed along the outer borders of the primary numeral color in the desired alignment.

The above procedure represented a cumbersome technique and a very high investment in inventory screens and frames. Further, it required skilled screen designers using great care and careful operators to assure proper positioning of the silk screens to avoid an unreasonably high number of rejected final products.

Another process used for direct numeral printing on such garments is referred to as the die cut process. In this process, a paper sheet is employed for each numeral image to be printed which is discarded after a single use.

Each new die cut sheet must be replaced in a fixed frame manually.

Those skilled in the art have failed to find a satisfactory solution to these long recognized disadvantages, therefore volume manufactureres have been required to continue to use these old and well-known cumbersome processes to print numeral indicia on such garments using the prior conventional printing apparatus.

SUMMARY OF INVENTION

The present invention relates generally to screen printing apparatus and particularly to a novel screen printing head assembly which is particularly well-adapted for the printing of numeral indicia on athletic shirts and jerseys or the like.

The apparatus of the present invention is useful on single and multiple color printing apparatus as well as single and multiple station machines.

The screen printing head assembly of the present invention is fixed to a conventional vertically pivoted arm which forms a portion of a conventional single or multiple station printing apparatus. The printing head assembly includes a pair of horizontal guide rails which slideably receive a carriage block which form a screen mounting or socket portion which receives the screen frame and cooperates with a registration plate mounted under the printing head and adjacent to the pallet to releasably fix the screen socket portion in one of a plurality of positions along a path of travel defined by the guide rails. The screen mounting portion preferably includes a recessed block forming a screen receiving socket adapted to removably receive the leading end of the silk screen in a close tolerance fit to automatically locate the screen in the same position every time a screen is replaced.

The multiple positions of the screen socket portion along the path of travel defined by the guide rails are predetermined to automatically align the screen in a selected position above the pallet holding the garment to be printed such as related to whether a single or double digit numeral is required. Therefore only 10 screens representing the numerals 0–9 are required to print any numeral from 0–99 in a given color and size instead of 100 such screens as required on prior conventional printing apparatus.

Since the socket portion provides automatic, positive positioning of the screen, manual alignment errors during replacement of a screen are eliminated. In combination with a single conventional toggle clamp, each screen may be mounted or removed in a facile manner requiring less manual effort and less time as compared to prior art printing apparatus.

Preferably the screen and its associated frame is provided with a plate or plug on its leading end dimensioned to properly mate in a close tolerance fit with the screen mounting recess or socket. However, a custom manufactured single digit size screen frame may be used if the leading end thereof is precisely made to assure the desired close tolerance fit with the socket portion.

In accordance with the present invention, a dramatically improved printing head assembly is provided which reduces the required inventory of printing screens for printing numerals or like indicia by a factor of 10.

OBJECTS

It is therefore an object of the present invention to provide an improved screen printing apparatus which incorporates a multi-position screen printing head assembly which permits any numeral between 0–99 to be accurately positioned and printed on a garment using only 10 printing screens per color or size of numeral.

It is another object of the present invention to provide an apparatus of the type described wherein the printing head assembly is provided with a unique socket mounting portion adapted to receive a leading end of a screen frame to precisely align the screen on the printing head in a quick and positive manner.

It is still another object of the present invention to provide an apparatus of the type described which dramatically reduces the time typically required in screen printing numeral indicia or the like on wearing apparel.

It is a further object of the present invention to provide an apparatus of the type described which is relatively simple to manufacture and use and yet provides the advantages referred to above.

It is yet another object of the present invention to provide an apparatus of the type described which permits the printing screen, after mounted in the socket portion of the head set, to be moved to a plurality of releasably fixed, horizontally spaced postiions precisely disposed in a predetermined relationship to the pallet holding the garment to be printed.

Further objects and advantages of the present invention will be apparent from the following description, reference being had to the accompanying drawings wherein preferred forms of embodiments of the invention are clearly shown.

IN THE DRAWINGS

Figure 1:
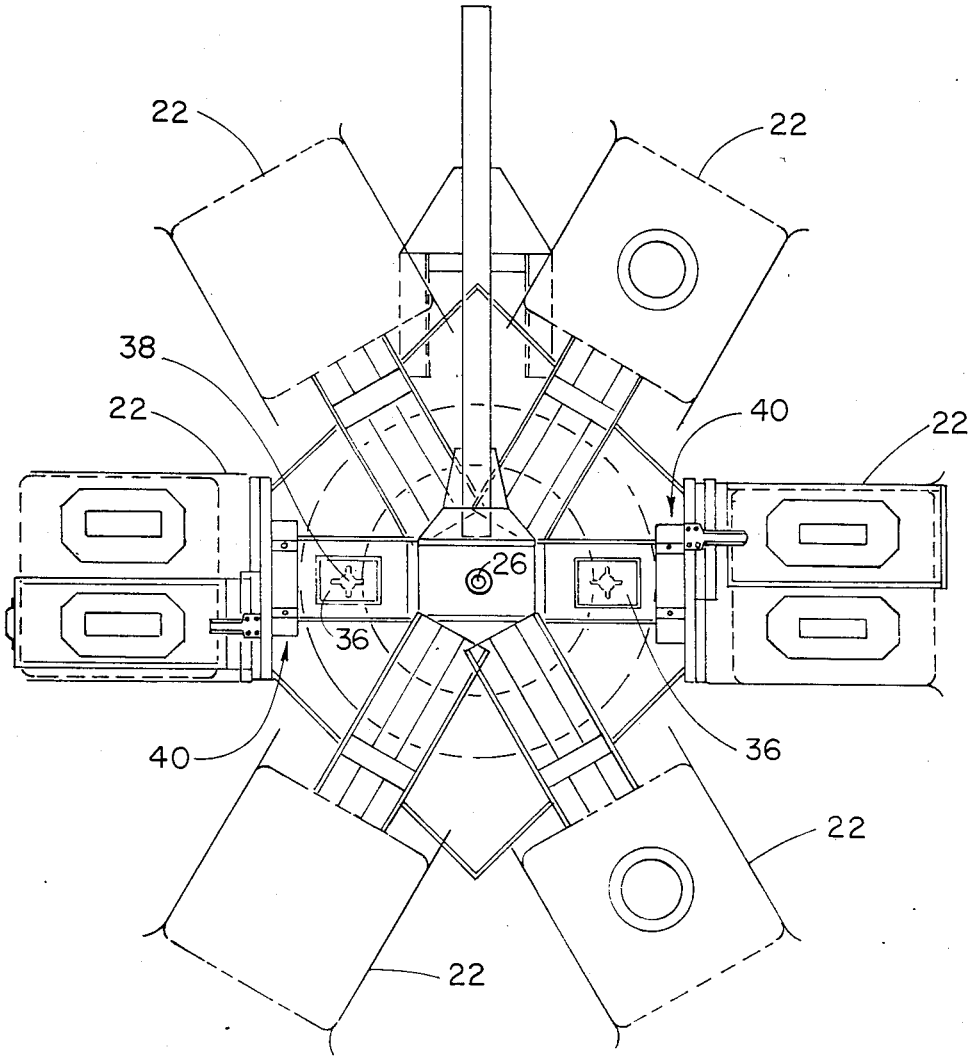
FIG. 1 is a top plan view of a multiple station screen printing apparatus incorporating a printing head assembly constructed in accordance with the present invention.
Figure 8:
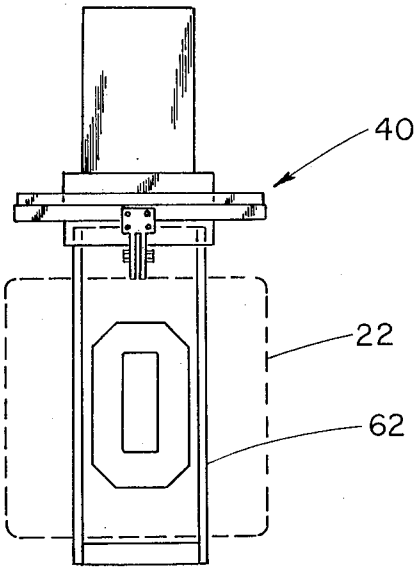
Figure 7:
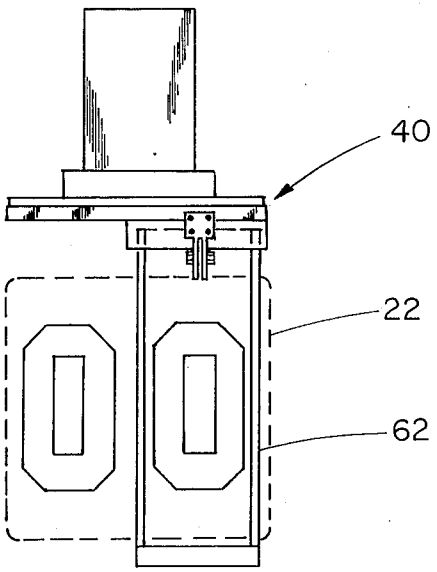

FIG. 7 is a top plan view of a pallet and a printing head assembly forming a portion of the apparatus illustrated in FIG. 1 showing one of the multiple registration positions of the printing head assembly for printing two digit numerals; and FIG. 8 is a top plan view similar to the view shown in FIG. 7 illustrating another registration position of the printing head assembly of the present invention for printing a single digit numeral.

DETAILED

A multiple station screen printing apparatus provided with a novel printing head assembly constructed in accordance with the present invention is shown in FIG. 1. For purposes of illustration, the printing head assembly of the present invention is shown in connection with an otherwise conventional multiple station printing apparatus such as manufactured and sold by RSP Industries in Columbus, Ohio. However, it is equally applicable to a single station screen printer as well as single and multiple color printing apparatus made by other manufacturers.

For purposes of brevity, a well-known conventional six station, two color printing apparatus is shown and will be generally described only so far as necessary to understand the operation of the present invention in a context recognized by those skilled in the art. It should be understood that the conventional features of such an apparatus form no part of the present invention standing alone.

Figure 2:
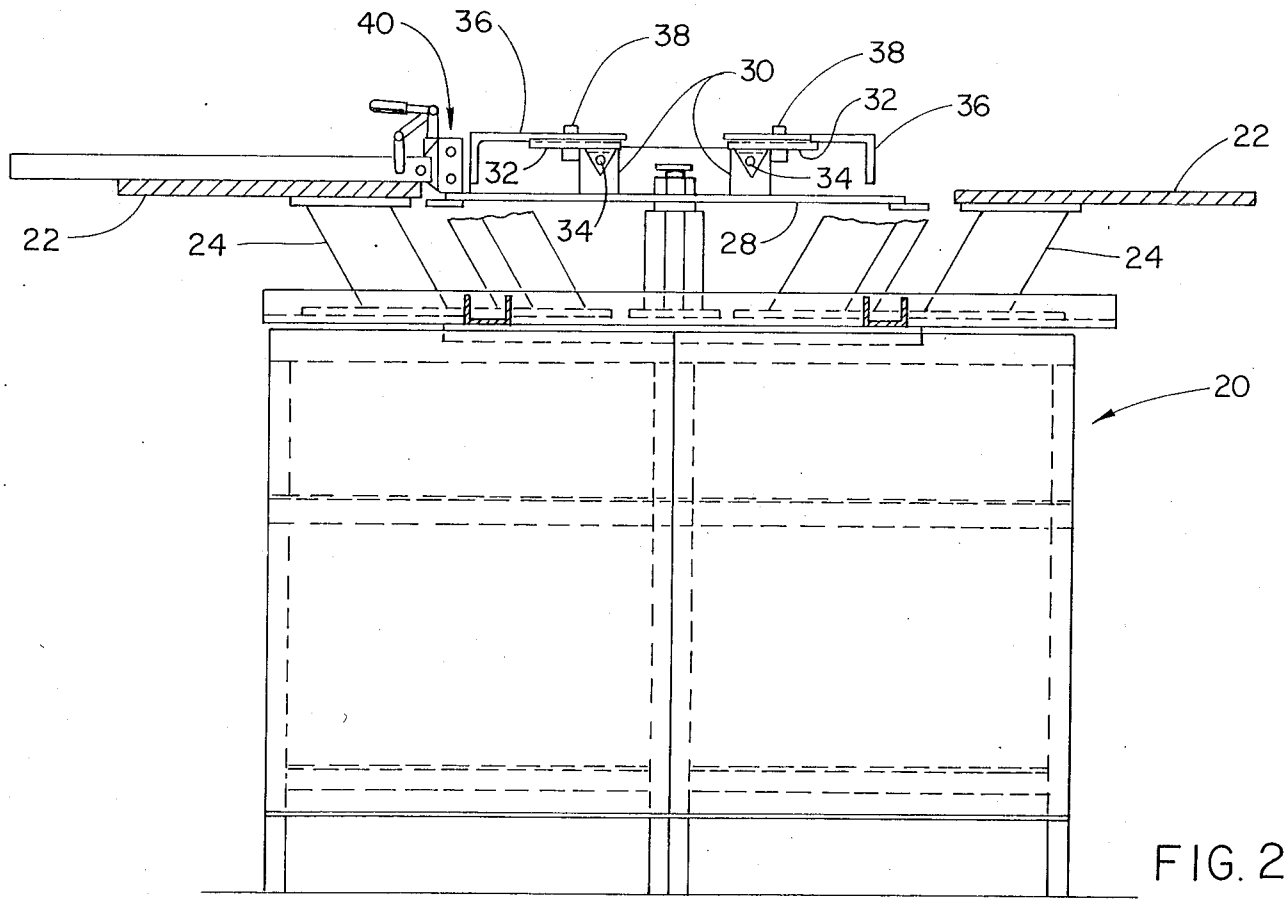
FIG. 2 is a right side elevational view of the apparatus shown in FIG. 1.
Figure 3:
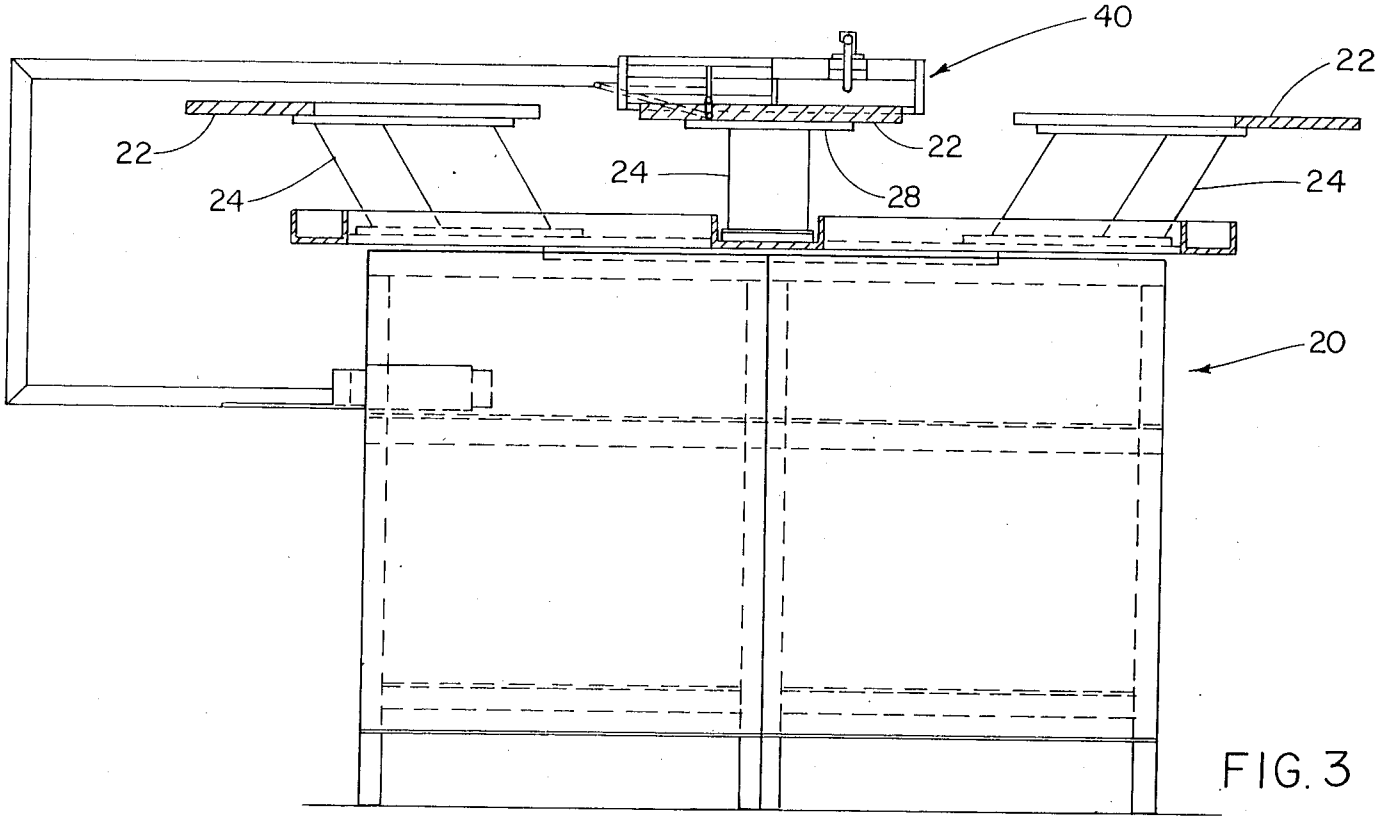
FIG. 3 is an end elevational view of the apparatus shown in FIG. 1 as viewed from an operator's position.

With reference to FIGS. 1–3, a rotatable indexing table and associated supporting frame is indicated generally at 20. Six material receiving pallets 22 are mounted on pallet supports 24 which in turn are mounted on table 20. Each pallet is automatically indexed to rotate to each of the six operating stations for loading and unloading, printing, drying and the like in a sequenced manner about a central shaft means 26.

As best seen in FIG. 2, a printing head base plate 28 is fixed to central shaft 26 and extends radially outward toward opposing printing stations and carries a pivot block assmebly 30 which includes a pivot arm 32 pivoted for vertical movement about a pivot pin 34.

An L-shaped bracket or hoe 36 is removably fixed to pivot arm 32 by means of a threaded hand knob 38 which is received in an appropriate aligned threaded opening in bracket 36 and arm 32. The foregoing brief description relates to the general structural features of conventional well-known, prior screen printing apparatus which are well adapted for utilization of the novel printing head assembly of the present invention to be described herein which replaces the printing head structures of the prior art.

The printing head assembly of the present invention is indicated generally at 40 and is mounted to the downwardly extending portion of support bracket 36 so that the printing head assembly 40 may be pivotably raised and lowered along with arm 32 and bracket 36 about pivot pin 34.

Figure 4:
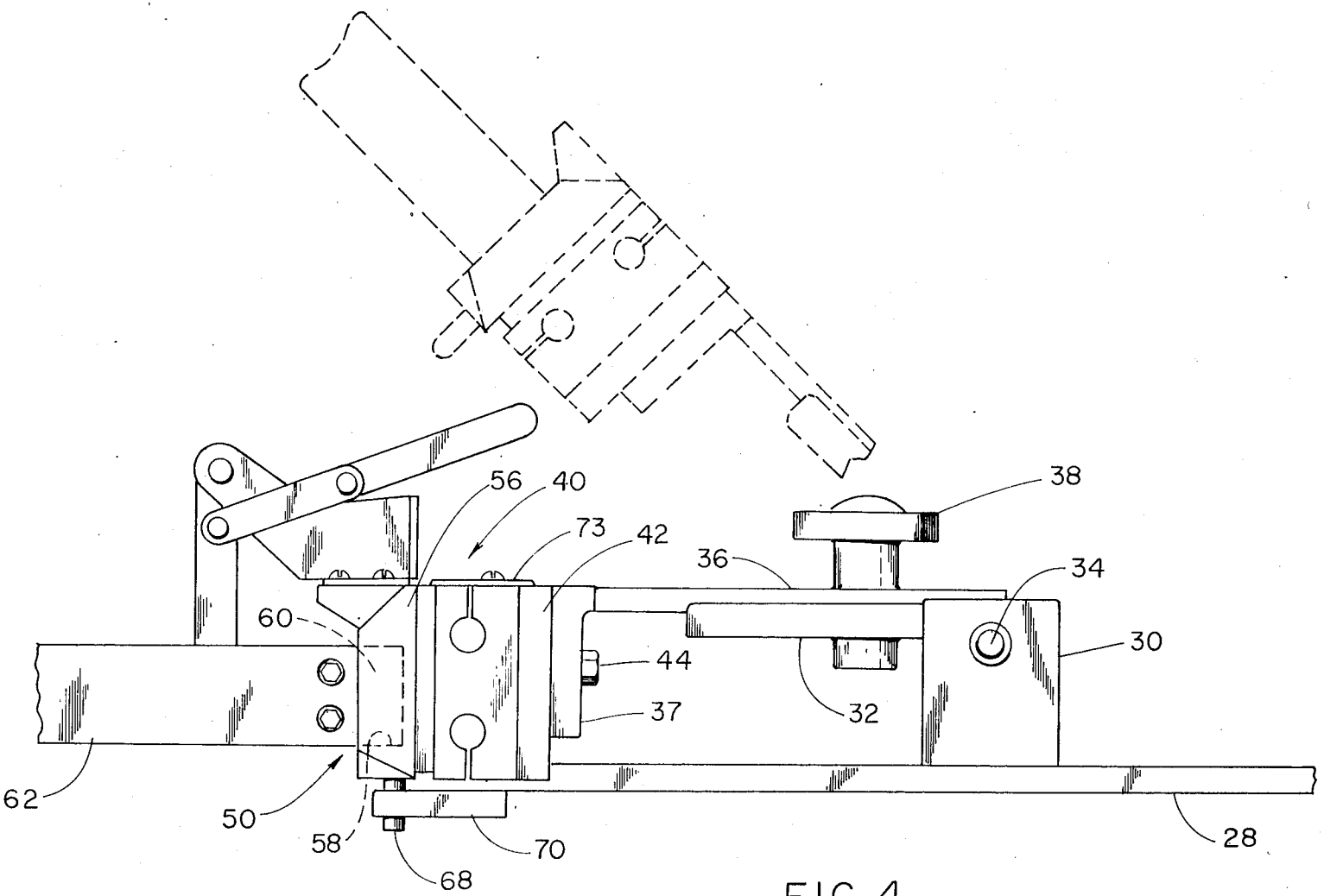
FIG. 4 is a side elevational view of a portion of the apparatus shown in FIG. 1 illustrating the novel printing head assembly constructed in accordance with the present invention.
Figure 5:
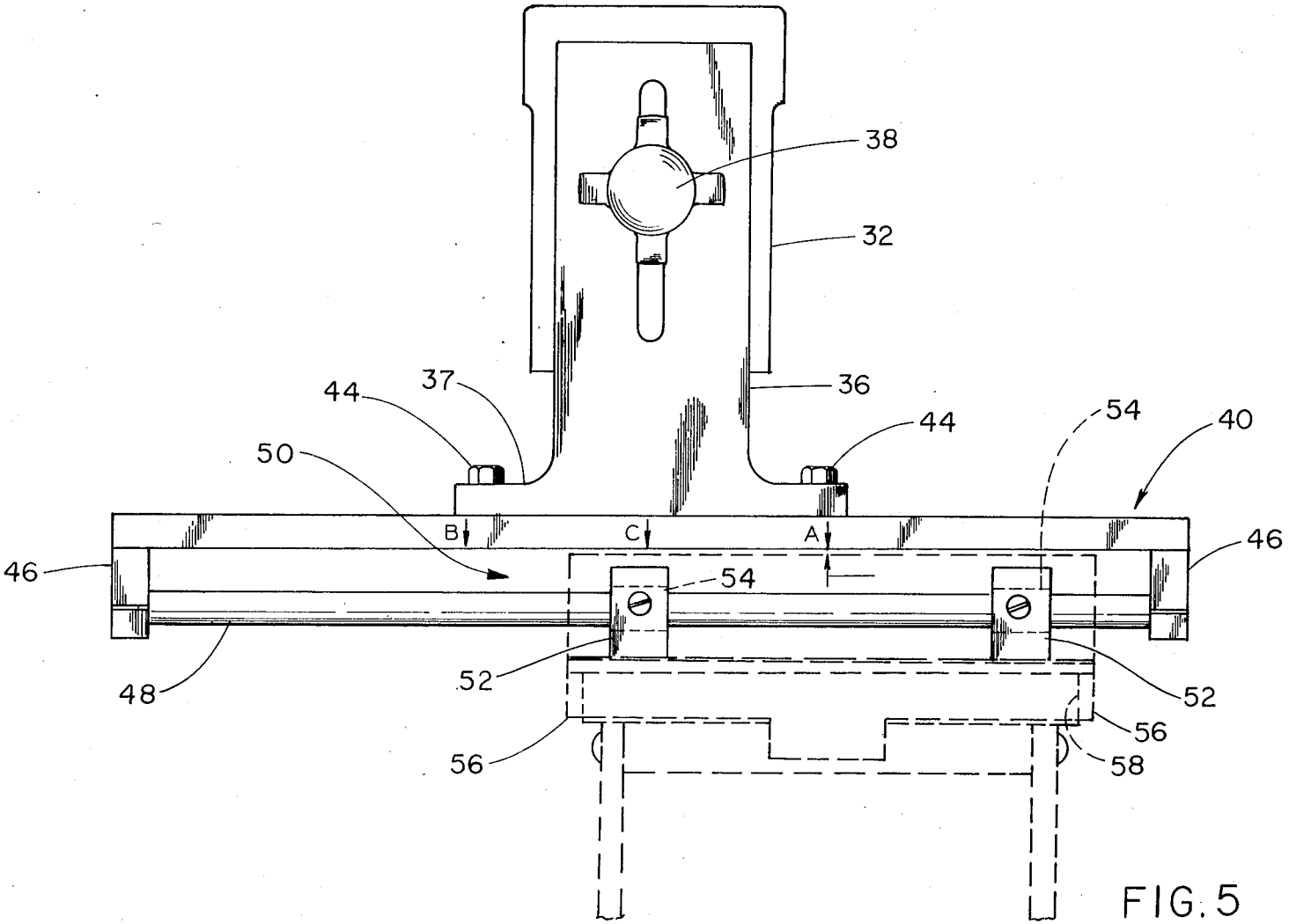
FIG. 5 is a top plan view of that portion of the apparatus shown in FIG. 4.
Figure 6:
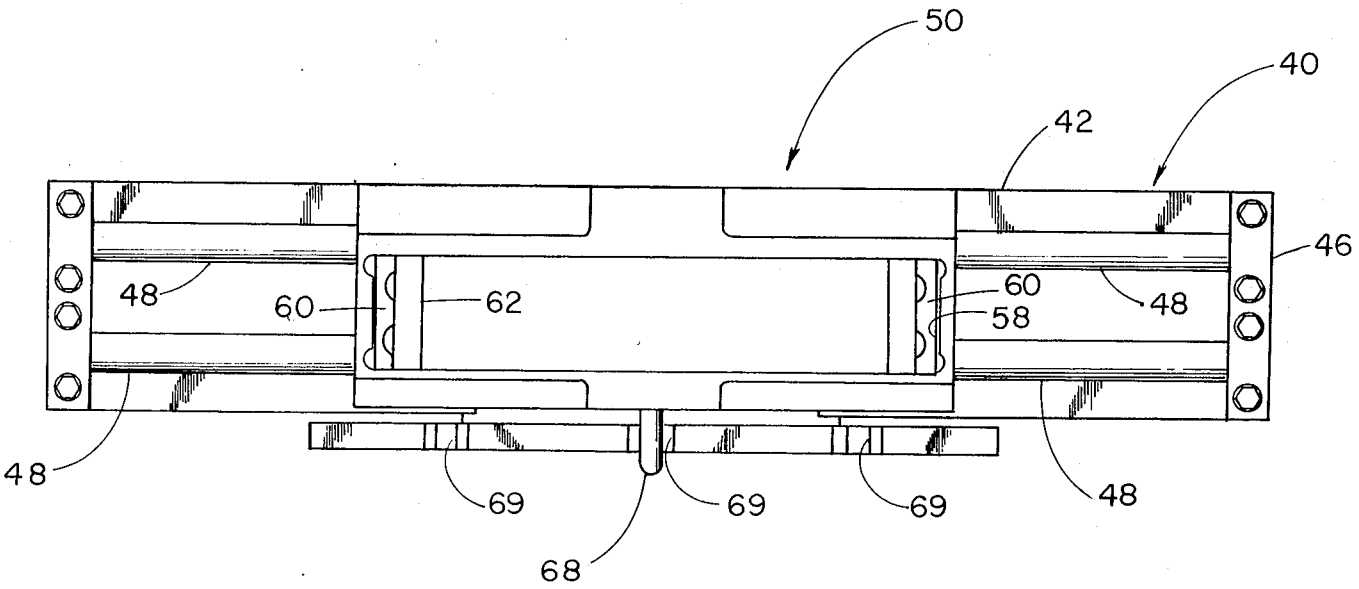
FIG. 6 is a front elevational view of that portion of the apparatus shown in FIG. 3 as viewed from an operator's position.

Now referring specifically to FIGS. 4, 5 and 6, a preferred embodiment of the printing head assembly 40 constructed in accordance with the present invention is shown. Printing head assembly 40 includes a support frame 42 fixed to the flanged downturned portion 37 of bracket 36 by a pair of bolts 44. Frame 42 includes side block members 46 which include a pair of holes which securely receive a pair of horizontally extending guide rails 48.

A carriage means, indicated generally at 50, is slideably mounted on guide rails 48 via a pair of rearwardly extending lugs 52 extending from the rear of support frame 42. Each lug 52 is provided with a vertically spaced pair of bores 54. A conventional bearing assembly not shown, is mounted in bores 54 to slideably support carriage means 50 on a respective rail 48. In this manner carriage means 50 is freely slideably supported on rails 48 between the outer side blocks 46 when it is disposed in the raised position.

Carriage means 50 further includes a screen mounting block 56. Preferably block 56 is provided with a outwardly facing rectangularly shaped recess 58 which forms a screen receiving socket. In the preferred embodiment shown, recess 58 is accurately machined to receive a plug plate 60. Plug 60 is mounted to the forward or leading end of a printing screen frame 62 which carries the printing screen. Plug plate 60 therefore is insertable into recess 58 in a close tolerance fit approximately between 0.0001 0.0003 inches. In this fashion, an operator merely inserts the plug plate 60 fixed to the leading end of a screen frame 62 into recess 58 and the screen frame is automatically positioned or registered in carriage member 50. Given the predetermined precise manufacture of the support arm 36 and remaining components of the printing head assembly, the lateral, vertical and forward extend of the screen frame may be accurately and repetitively located in this manner without introducing manual sighting alignment error by the operator.

This precise alignment feature merely requires an identical carriage member 50 to be used to mount a screen frame having an identical plug plate 60 fixed thereto in the screen production room during the image creating process for each screen. Then the finished screen will always be precisely mounted to the printing head assembly as herein described relative to the fixed position of the pallet for receiving the material.

After a screen frame 62 is mounted in recess or socket 58, a conventional toggle clamp 64 may be employed to releasably secure the frame 62 in the intended position during the printing process.

Since carriage means 50 is freely slideable on rails 60, it may be moved laterally to a plurality of positions overlying pallet 22. To fix carriage 50 in a given lowered printing position, a downwardly extending pin member 68 is provided on the bottom surface of mounting block 56. Pin 68 is adapted to be received in one of a plurality of slots or open-mouthed openings 69 provided in a registration plate 70. Plate 70 is fixed to base plate 28 and is accurately located relative to pallet 22 to permit precise registration of carriage means 50 in predetermined printing positions along the path of travel on rails 48.

Merely pivoting printing head assembly upward raises pin 68 from a slot 69 freeing carriage 50 and any screen mounted thereon to be moved laterally to a new position. Lowering the printing head at a position wherein pin 68 may enter a corresponding slot 69 fixes the printing head in a given printing position at the desired lateral and vertical location overlying pallet 22.

To aid the operator to quickly align the carriage 50 and a screen frame 62 in the desired position, indicia may be provided on support frame 42, such as indicated by the arrows and letters A, B, C in FIG. 5, which are vertically aligned with a respective slot 69 provided in registration plate. Similar locator indicia, such as an arrow or the like at 72 in FIGS. 5, which is aligned with pin 68 may be provided on a cover plate 73 fixed on top of carriage 50. The operator, by aligning the respective arrow 72 with either the A, B, and C indicia, may easily and quickly locate the desired lateral position of carriage 50 to lower the printing head assembly to insert pin 68 in the desired slot 69.

To provide an example of this procedure as employed in numeral printing, FIGS. 7 and 8 diagramatically illustrate a right, left and center position of carriage 50 relative to a pallet 22 and a garment placed thereon with a screen frame 62 mounted in socket 58.

FIG. 7 illustrates the printing location of a two digit numeral using the same screen having a "zero" numeral image. The screen is merely shifted laterally between the A and B positions illustrated in FIG. 5 as described herein. Further without changing the printing screen, another garment could be printed with the same "zero" numeral in the center or "C" position illustrated in FIG. 1

Of course, a separate printing screen frame 62 having the desired numeral image must be inserted into the socket portion 58 each time a different numeral from zero to nine is to be printed. However, only 10 such screens are required to print a given size and color of numerals from 0 to 99. Employing the socket construction disclosed herein permits such screens to be removed and replaced in a faster, more accurate manner compared to prior conventional apparatus.

A further step which saves time occurs each time a double digit number having the same digits must be printed in that the single digit screen need not be changed and replaced such as described in the foregoing example of printing numeral double "zero".

It is important to point out that the concept of the present invention relates to the relative horizontal displacement between the printing screen mounted in the printing head assembly and the pallet upon which the material to be printed is held. Therefore, one might choose to keep the horizontal position of the screen mounting means fixed and provide a pallet which is slideably movable to a plurality of positions. While the embodiment described herein represents the preferred form, providing a similarly slideably pallet with a horizontally fixed position screen holding means would provide the desired multiple printing positions in accordance with the present invention.

In view of the foregoing decription, it should be readily apparent that the present invention represents a very significant advance in the art and provides a novel construction which increases the quality of the results, increases the operator's production capacity, and dramatically saves costs by reducing the number of screens which must be produced and inventoried for this application.

It is also important to point out that printing applications other than the numeral printing as described herein may find advantages employing the apparatus constructed in accordance with the present invention.

What is claimed is:

1. An improved screen printing apparatus having a base means supporting a material receiving pallet to define a printing station and a screen printing head assembly pivotally mounted to said base means for vertical movement toward and away from said pallet to define a lowered printing and raised non-printing position relative to said pallet, the improvement comprising said printing head assembly including a screen mounting means adapted to releasably receive a printing screen, said mounting means being slideably mounted on said printing head assembly, when disposed in said raised non-printing position, for movement in a plane parallel to the pivot axis of said printing head assembly said screen mounting means including first locating measn thereon cooperable, when in the lowered printing position, with one of a plurality of second locating means on said base means to releasably fix said screen mounting means in one of a plurality of printing locations.

2. The apparatus defined in claim 1 wherein said screen mounting means includes an outwardly facing front opening to a socket-like enclosure provided with rear, side and bottom walls; and a printing screen having a leading end removably inserted into said opening of said enclosure in a close tolerance fit relationship to said walls to automatically locate said screen in a preselected lateral and longitudinal position in said screen mounting means relative to said pallet.

3. An improved screen printing apparatus of the type having a base supporting a material receiving platen and a support arm mounted on said base and extending outwardly toward said platen; the improvement comprising, in combination, a screen printing head assembly means pivotally mounted on said support arm for vertical movement between a raised non-printing position and a lowered printing position overlying said platen and including a support frame provided with horizontally disposed rail means extending generally parallel to the pivot axis of said printing head assembly means, and a carriage member slideably mounted on said rail means for travel along said rail means, said carriage member including a channel disposed parallel to the path of travel of said carriage member and adapted to receive the leading end of a Printing screen in a releasably fixed relationship; and means to releasably fix said carriage member in one of a plurality of laterally spaced printing locations along the path of travel on said rail means related to preselected registration locations overlying said platen upon downward pivoting of said printing head to said lowered printing position said fixing means comprising first locating means on said carriage member cooperable with one of a plurality of second locating means on said base.

4. An apparatus for printing numeral insignia or the like on a flexible material comprising in combination, a base frame provided with a perpendicular shaft means; generally horizontally disposed platen means mounted for rotation about said shaft means to one of a plurality of preselected positions; screen printing head assembly means mounted on said base frame for pivotal movement on an axis transverse to said shaft means for movement toward and away from said platen means between non-printing and printing positions, said screen printing head assembly means including a block frame member fixed on an outer end of a vertically pivoted support are mounted on said base frame, said block frame means including rail means horizontally disposed in a plane parallel to the pivot axis of said support arm; carriage means slideably mounted on said rail means when said printing head is disposed in said non-printing position and including a recess forming a screen receiving socket to removably receive a leading end of a printing screen in a close tolerance fit with said socket on said carriage means; and means to releasably fix said carriage means in one of a plurality of preselected locations along the path of travel defined by said rail means, said preselected locations related to the desired locations of a printing screen mounted on said carriage means when said printing head assembly means and said printing screen are lowered to said printing position said fixing means comprising first locating means on said carriage means cooperable with one of a plurality of second locating means on said base frame.

5. An improved screen printing apparatus having a base means supporting a flexible material receiving pallet to define a printing station and a screen printing head assembly including screen receiving mounting means, said printing head assembly being pivotally mounted to said base means for vertical movement toward and away from said pallet to define a printing and non-printing position relating to said pallet, the improvement comprising said screen receiving mounting means and said pallet being mounted for slideable movement relative to one another in a plane parallel to the pivot axis of said printing head assembly when said printing head assembly is disposed in said non-printing position and means releasably fixing said screen receiving mounting means in one of at least three horizontally spaced printing locations when said printing head assembly is disposed in said printing position; and a printing screen means removably mounted in said screen receiving mounting means and bearing a single digit numeral between 0 and 9, whereby a single digit numeral may be printed upon a flexible material fixedly disposed on said pallet in any one of at least three horizontally spaced locations said fixing means comprising first locating means on said screen receiving mounting means cooperable with one of at least three second locating means on said base means.

* * * * *